United States Patent [19]

Brucciani

[11] 4,055,857

[45] Nov. 1, 1977

[54] DISPOSABLE CAPS

[75] Inventor: Richard Louis Brucciani, Leicester, England

[73] Assignee: The Paper Lynen Co. Ltd., England

[21] Appl. No.: 617,658

[22] Filed: Sept. 29, 1975

[30] Foreign Application Priority Data

Oct. 16, 1974 United Kingdom ..... 44916/74

[51] Int. Cl.[2] ..... A42B 1/22

[52] U.S. Cl. ..... 2/197

[58] Field of Search ..... 2/197, 195

[56] References Cited

U.S. PATENT DOCUMENTS

| | | | |
|---|---|---|---|
| 3,383,709 | 5/1968 | Bauer | 2/197 |
| 3,564,612 | 2/1971 | Wagenfeld | 2/197 |

*Primary Examiner*—Werner H. Schroeder
*Assistant Examiner*—Peter Nerbun
*Attorney, Agent, or Firm*—Larson, Taylor and Hinds

[57] ABSTRACT

A disposable cap of paper or the like is made of a headband and an accordion-pleated crown. The headband is made as a length of flattened open-ended tube of which one end is inserted and telescoped into the other end and adjusted for head-size fitting.

1 Claim, 7 Drawing Figures

DISPOSABLE CAPS

This invention relates to caps made of paper of similar light flexible sheet material which are worn in hospitals, the food industry, catering establishments and so on and are disposable when soiled.

In many cases such caps comprise a headband with a crown attached to it. Although the caps are not meant to be close fitting, heads of widely differing sizes call for different headband sizes to be kept in stock. The present invention has been divised with the object of providing a disposable cap of the kind set forth which is quickly adjustable in size without involving significant extra expense in material or fabrication.

To this end we provide a disposable cap comprising a headband in the form of a flattened open-end tube of paper or like sheet material provided intermediate its length with transverse creases dividing it into three sections and enabling it to be folded into a closed annulus with the ends of the flattened tube overlapping one another, and a crown composed of an accordion-pleated sheet of paper or like sheet material which is gummed at its lateral edges to and between two opposed sections of the folded headband tube, leaving a third section of this tube free and overlapping the sections to which the crown is connected. To assemble the cap, all that is required is to push the end of the free third section of the headband into the open opposite end of the first section of the tube. It can then be telescoped into this end to a greater or lesser degree to adjust the headband to the required size. It has been found that with a headband tube of uniform width there is sufficient friction between the telescoped parts to retain it in its adjusted position under normal conditions of wear.

In a preferred from of the invention the section section of the headband, namely that to which the third section is attached, is of greater length than the first section, and the pleated crown is of greater length than the second headband section and the surplus length of this crown is gummed to the third headband section.

Figure 2:
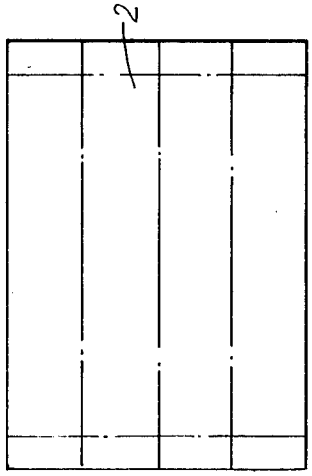
Figure 1:
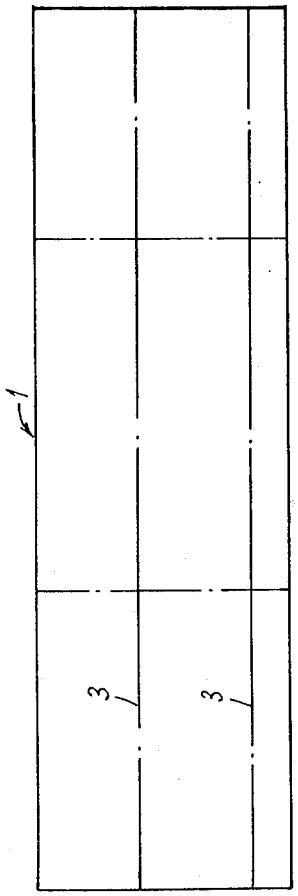
Figure 3:
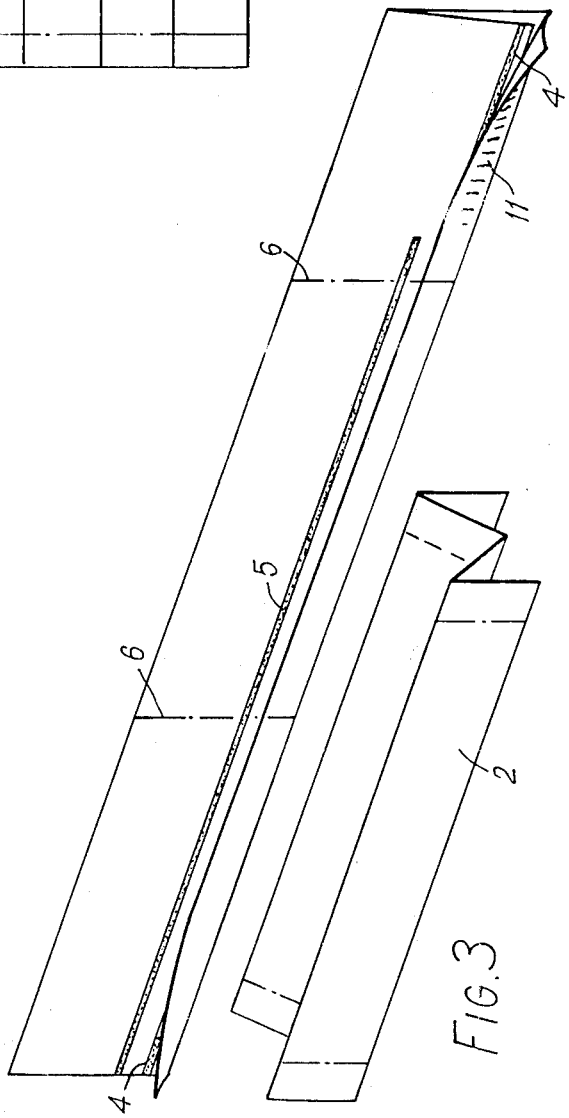
Figure 4:
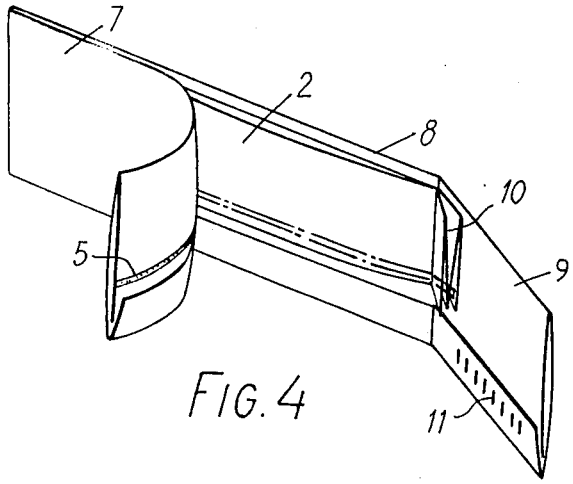
Figure 5:
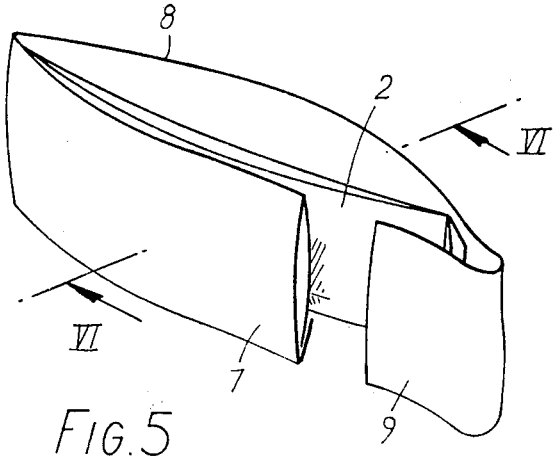
Figure 6:
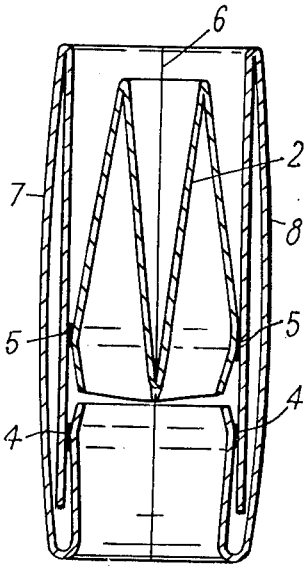
Figure 7:
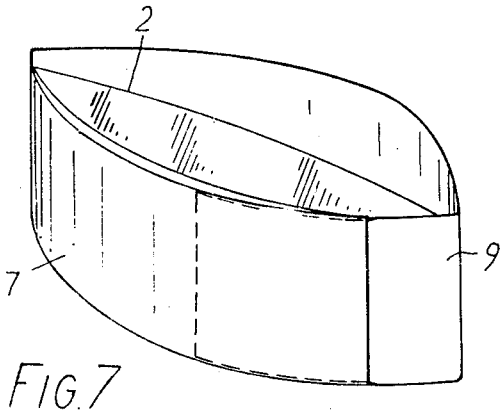

The invention will now be described with reference to the accompanying drawings in which:

FIG. 1 is a plan view of a blank of crepe paper for forming the headband of a cap, FIG. 2 is a similar view of a sheet of paper used to form the crown of a cap, FIG. 3 is a perspective illustration of the headband and crown both in the intermediate stage in the fabrication of the cap, FIG. 4 is a similar view of a further stage in the assembly, FIG. 5 is a perspective illustraion of yet another stage in the fabrication, FIG. 6 is a cross section on the line VI—VI of FIG. 5, and FIG. 7 is an illustration of the finally assembled cap.

Referring to the drawings the headband blank is generally designated 1, and the crown blank 2. The headband blank 1 is formed into a tube along longitudinal crease lines 3 and the tube secured by a line of gumming 4. This tube is flattened and is provided with a further line of gumming 5 which terminates short of one end of the blank, as seen in FIG. 3. The crown blank 2 is accordion-pleated and secured to the headband tube 1 by the gum line 5, being positioned relatively to the headband blank as shown in FIG. 3. The assembly is completed by folding the headband/crown arrangement about transverse crease lines 6. As will be observed from FIG. 4 this divides the headband into a first section 7, a second and opposed section 8, and a third section 9 which, in the assembled condition overlaps the sections 7 and 8 to which the crown is gummed. It will also be observed that section 8 is of greater length than section 7, so producing the arrangement illustrated in FIG. 5. It will also be observed that the pleated crown blank is of greater length than the second headband section 8 and the surplus length 10 of this pleated crown is lightly gummed to the headband section 9.

The arrangement is now that illustrated in FIG. 5 from which it will be observed that in use the headband section 9 is simply tucked into the end of the tube constituted by the headband section 7 and can be adjusted to the required size by telescoping it to a greater or lesser degree in the tube end at 7. The headband blank will conveniently be provided with a marking 11 to determine the adjusted size.

The caps described can be made seriatim the headband material, for example crepe paper, being continuously fed to a printing device followed by gumming to produce the line 4 of gum, a folding device to form it into a continuous tube and then to a flattening device. Similarly the crown stock of tissue paper or like sheet material can be independently accordion-pleated as a running web and cut by knife means into the M-section crown blanks, these being deposited in turn on the running headband web and flattened and consolidated with the latter. This will be followed by severing the headband at intervals to produce a series of assemblies such as that illustrated in FIG. 4, whereafter these are individually folded.

I claim:

1. An improved disposable cap comprising a headband consisting of a flattened open-ended tube of paper or like sheet material formed by folding inwardly a strip of said paper or the like along two intermediate longitudinal creases so that one marginal longitudinal panel so formed overlaps the opposite marginal longitudinal panel and so as to form an outer panel and an uppermost marginal panel and a lowermost marginal panel, said overlapping marginal panels being secured by an adhesive, and said lowermost panel lying inwardly of said outer panel and said uppermost panel to form a headband, the uppermost panel being substantially wider than the lowermost panel and overlapped by said lowermost panel by a substantial amount so that a triple thickness of said panels is provided in the area of said headband, said tube being provided intermediate its length with transverse creases dividing the tube into three sections and enabling the tube to be folded into a closed annulus with one end of the flattened open-ended tube inserted within the outer end of said tube, and a crown composed of an accordion-pleated sheet of paper or like sheet material which is secured by an adhesive at the lateral edges thereof to and between two opposed overlapped uppermost outer marginal longitudinal panels of the folded headband tube, leaving a third section of said tube free and in overlapping relationship to the sections to which the crown is connected, whereby the annulus is maintained in shape solely by the force of friction between the layers of material from which the annulus is made, the second section of the headband, to which the third section is attached, being of greater length than the first section, and the pleated crown being of greater length than the second headband section and the surplus length of this crown being secured by an adhesive to the third headband section to provide crown material for expansion of the crown when the headband is expanded.

* * * * *